US007427958B2

(12) United States Patent
Yoon et al.

(10) Patent No.: US 7,427,958 B2
(45) Date of Patent: Sep. 23, 2008

(54) DUAL BAND ANTENNA UNIT FOR MOBILE DEVICE

(75) Inventors: Il Bae Yoon, Suwon-si (KR); Kee Dug Kim, Seoul (KR); Seong Wook Lee, Suwon-si (KR)

(73) Assignee: Samsung Electronics Co., Ltd. (KR)

( * ) Notice: Subject to any disclaimer, the term of this patent is extended or adjusted under 35 U.S.C. 154(b) by 5 days.

(21) Appl. No.: 11/647,022

(22) Filed: Dec. 28, 2006

(65) Prior Publication Data

US 2008/0024372 A1 Jan. 31, 2008

(30) Foreign Application Priority Data

Jul. 28, 2006 (KR) ..... 10-2006-0071218

(51) Int. Cl.
*H01Q 1/24* (2006.01)

(52) U.S. Cl. ..... 343/702; 343/901

(58) Field of Classification Search ..... 343/702, 343/901

See application file for complete search history.

(56) References Cited

U.S. PATENT DOCUMENTS

| | | | | |
|---|---|---|---|---|
| 5,909,194 | A | 6/1999 | Umeda et al. | 343/702 |
| 6,351,241 | B1 | 2/2002 | Wass | 343/702 |
| 6,359,592 | B1 | 3/2002 | Chen et al. | 343/895 |
| 6,380,898 | B1 * | 4/2002 | Moore et al. | 343/702 |
| 7,046,205 | B2 * | 5/2006 | Tamez | 343/702 |
| 2004/0121828 | A1 | 6/2004 | Wang et al. | 455/575.7 |
| 2005/0007282 | A1 | 1/2005 | Martiskainen et al. | 343/702 |

FOREIGN PATENT DOCUMENTS

| | | |
|---|---|---|
| EP | 0 997 967 | 5/2000 |
| EP | 1 667 279 | 6/2006 |
| JP | 11-177332 | 7/1999 |
| JP | 2001-144525 | 5/2001 |
| JP | 2003-283224 | 10/2003 |
| KR | 1020050066001 | 6/2005 |
| KR | 1020050122992 | 12/2005 |
| KR | 1020060014657 | 2/2006 |
| KR | 1020060034666 | 4/2006 |
| KR | 1020060102062 | 9/2006 |
| WO | WO 00/10223 | 2/2000 |

* cited by examiner

*Primary Examiner*—Trinh V Dinh
*Assistant Examiner*—Dieu Hien T Duong
(74) *Attorney, Agent, or Firm*—The Farrell Law Firm, P.C.

(57) ABSTRACT

A dual band antenna unit for a mobile device may include an antenna receiving part, a first antenna part having a first contact point and a second contact point, a second antenna part, a first feed point and a second feed point. The second antenna part may be formed integrally with the first antenna part and may extend from the first antenna part. The second antenna part may be extractably and retractably mounted in the mobile device. The first antenna part and the second antenna part may have resonant frequencies of different frequency bands. When the second antenna part is extracted, the first contact point may contact the first feed point. When the second antenna part is retracted, the second contact point may contact the second feed point. The mobile device may operate in different frequency bands using a single antenna unit, thereby allowing freedom of internal design and meeting the demand for miniaturization.

10 Claims, 4 Drawing Sheets

DUAL BAND ANTENNA UNIT FOR MOBILE DEVICE

PRIORITY

This application claims benefit of priority under 35 U.S.C. §119 of Korean Patent Application No. 2006-71218, filed on Jul. 28, 2006, the entire contents of which are incorporated herein by reference.

BACKGROUND OF THE INVENTION

1. Field of the Invention

The present invention relates to a dual band antenna unit for a mobile device, and more particularly, to a dual band antenna unit for a mobile device, in which antennas for different frequency bands are united in a single antenna unit.

2. Background of the Related Art

Generally, a mobile device is a mobile telecommunication apparatus having a variety of functions, such as wireless communication, network connections, or digital broadcast reception. The mobile device has an antenna for improved wireless communication. The antenna is used in sending or receiving radio frequency waves for wireless communication. The antenna is formed according to a desired frequency and/or wavelength. For effective antenna operation, the antenna can only resonate at one particular frequency.

Recently, the trend is for mobile devices to move towards miniaturization as well as multifunction, for example wireless communication, wireless Internet communication, navigation, digital broadcast reception, or Bluetooth communication. Accordingly, various frequency bands may be specified and a plurality of frequency bands may be utilized in a mobile device.

As mobile devices utilize more frequency bands, the mobile devices require more antennas corresponding to more frequency bands. As a result, the size of mobile devices may increase.

A solution has been suggested to use only one antenna for the adjacent frequencies. However, it is difficult to use only one antenna for non-adjacent frequencies and frequency bands, and as a result different antennas are used corresponding to different frequency bands.

A conventional mobile device has different antennas for transmitting communication signals of different frequency bands. Take for example, a mobile device that provides digital broadcast service and Bluetooth® (hereinafter, "Bluetooth", a short range radio communication technique) service. The frequency band of Bluetooth is 2.4 GHz, whereas the frequency band of Satellite Digital Multimedia Broadcasting (S-DMB) is 2.63 to 2.655 GHz, and the frequency band of Terrestrial DMB (T-DMB) is 174 to 240 MHz and 1.452 to 1.492 GHz. The difference in frequency bands between Bluetooth signals and DMB signals requires the mobile device to have different corresponding antennas.

Further, an antenna for DMB and an antenna for Bluetooth are installed at different locations in a mobile device, causing an antenna mounting space to occupy a considerable portion of the mobile device, thus failing in miniaturization of the mobile device. Further, this may result in a complicated process for producing a mobile device.

SUMMARY OF THE INVENTION

A preferred embodiment of the present invention provides a dual band antenna unit that operates in different frequency bands.

Another preferred embodiment of the present invention provides a dual band antenna unit that simultaneously provides DMB service and Bluetooth service.

A further preferred exemplary embodiment of the present invention provides a dual band antenna unit that has a reduced antenna mounting space, thereby allowing freedom of internal design and meets the demand for miniaturization of a mobile device.

According to an embodiment of the present invention, a dual band antenna unit for a mobile device may include a first antenna part, a second antenna part and an antenna receiving part. The antenna receiving part receives the first antenna part and the second antenna part. The second antenna part is formed integrally with the first antenna part and extends from the top of the first antenna part. The second antenna part is extractably and retractably mounted in the mobile device. The first antenna part preferably has a resonant frequency corresponding to a first frequency band. When the second antenna part is extracted, the second antenna part has a resonant frequency corresponding to a second frequency band.

The dual band antenna unit further includes a first feed point formed in the antenna receiving part at one position thereof and a second feed point formed in the antenna receiving part at a lower position thereof than the first feed point. The first antenna part has a first contact point formed at an upper portion thereof and a second contact point formed at a lower portion thereof. When the second antenna part is extracted, the first contact point is connected to the first feed point. When the second antenna part is retracted, the second contact point is connected to the second feed point.

The first frequency band may be a Bluetooth signal frequency band and the second frequency band may be a digital broadcast signal frequency band.

The first antenna part is preferably located in the mobile device, and the first antenna part is a helical antenna.

According to another embodiment of the present invention, a dual band antenna unit for a mobile device includes an antenna, an antenna receiving part, a third feed point and a fourth feed point. The third feed point is formed in the antenna receiving part at an upper position thereof and the fourth feed point is formed in the antenna receiving part at a lower position thereof. The antenna is extractably and retractably mounted in the mobile device. The antenna has a third contact point and a fourth contact point. When the antenna is extracted, the third contact point is connected to the third feed point, and the antenna is preferably divided into a third antenna part and a fourth antenna part with regard to the third contact point. When the antenna is retracted, the fourth contact point is connected to the fourth feed point, and a portion of the antenna protrudes from the fourth contact point in an inward direction of the mobile device, the protruding portion of the antenna thereby becoming a fifth antenna part.

The third antenna part preferably has a resonant frequency of a third frequency band, and the fourth antenna part has a resonant frequency of a fourth frequency band. The third frequency band may also be a digital broadcast signal frequency band, and the fourth frequency band may be a Bluetooth signal frequency band.

The fifth antenna part preferably has a resonant frequency of a fifth frequency band.

The resonant frequency of the fourth antenna part is preferably equal to the resonant frequency of the fifth antenna part.

The dual band antenna unit may further include a stopper. When the antenna is retracted, the third contact point contacts the stopper.

BRIEF DESCRIPTION OF THE DRAWINGS

The above and other objects, features and advantages of the present invention will become more apparent from the following detailed description in conjunction with the accompanying drawings, in which.

DETAILED DESCRIPTION OF THE PREFERRED EMBODIMENTS

Hereinafter, preferred embodiments of the present invention are described in detail with reference to the accompanying drawings. Some constructions or processes known in the art may be not described to avoid obscuring the invention in unnecessary detail. Particular terms can be defined to describe the invention in the best manner. Accordingly, the meaning of specific terms or words used in the specification and the claims should not be limited to the literal or commonly employed sense, but should be construed in accordance with the spirit of the invention. The description of the various embodiments is to be construed as exemplary only and does not describe every possible instance of the invention. Therefore, it should be understood that various changes may be made and equivalents may be substituted for elements thereof at the time of this filing.

Figure 1:
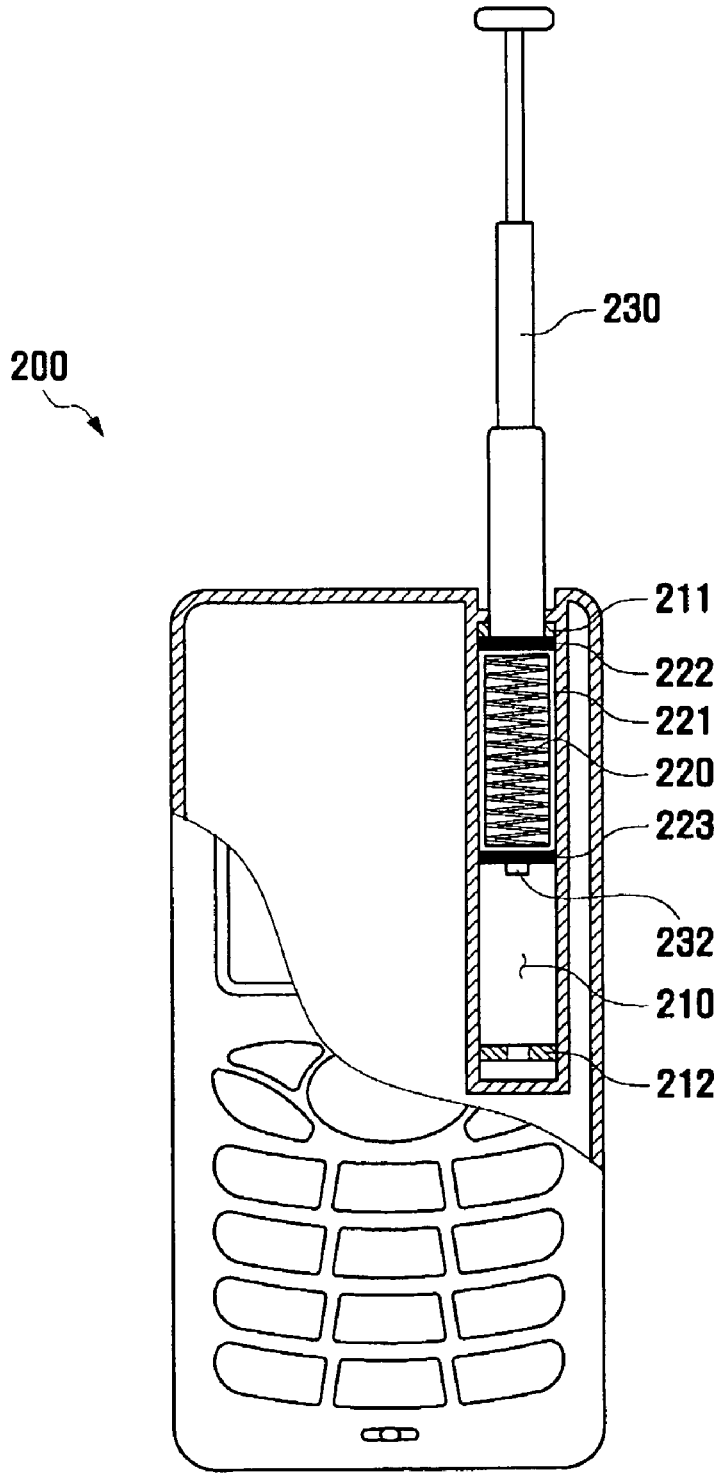
FIG. 1 is a partial cross-sectional view illustrating extraction of a dual band antenna unit for a mobile device according to the present invention.

FIG. 1 is a partial cross-sectional view illustrating extraction of a dual band antenna unit for a mobile device 200 in accordance with the present invention.

Referring to FIG. 1, the dual band antenna unit may include an antenna receiving part 210, a first antenna part 220, a second antenna part 230, a first feed point 211, and a second feed point 212. The antenna receiving part 210 may be an internal space, into which the first antenna part 220 and the second antenna part 230 may be retracted.

The first antenna part 220 is preferably a helical antenna, but is not limited in this regard. The first antenna part 220 has a first contact point 222 formed at an upper portion thereof and a second contact point 223 formed at a lower portion thereof. The first antenna part 220 is located within the antenna receiving part 210 regardless of extraction or retraction of the second antenna part 230. In alternative embodiments, when the antenna unit is extracted, the first antenna part 220 may protrude outwards from the mobile device 200.

The second antenna part 230 may be formed integrally with the first antenna part 220. The second antenna part 230 is extractably and retractably mounted in the mobile device 200.

When the second antenna part 230 is extracted, the first antenna part 220 formed integrally with the second antenna part 230 moves upwards in the antenna receiving part 210, bringing the first contact point 222 in contact with the first feed point 211.

The first antenna part 220 has a resonant frequency corresponding to a first frequency band, and the second antenna part 230 has a resonant frequency corresponding to a second frequency band. Therefore, the antenna unit may transmit and receive signals of different frequency bands. For example, the first frequency band may be set to a frequency band for Bluetooth signals and the second frequency band may be set to a frequency band for digital broadcast signals. Thereby the mobile device simultaneously provides digital broadcast function and Bluetooth function using a single antenna unit.

Figure 2:
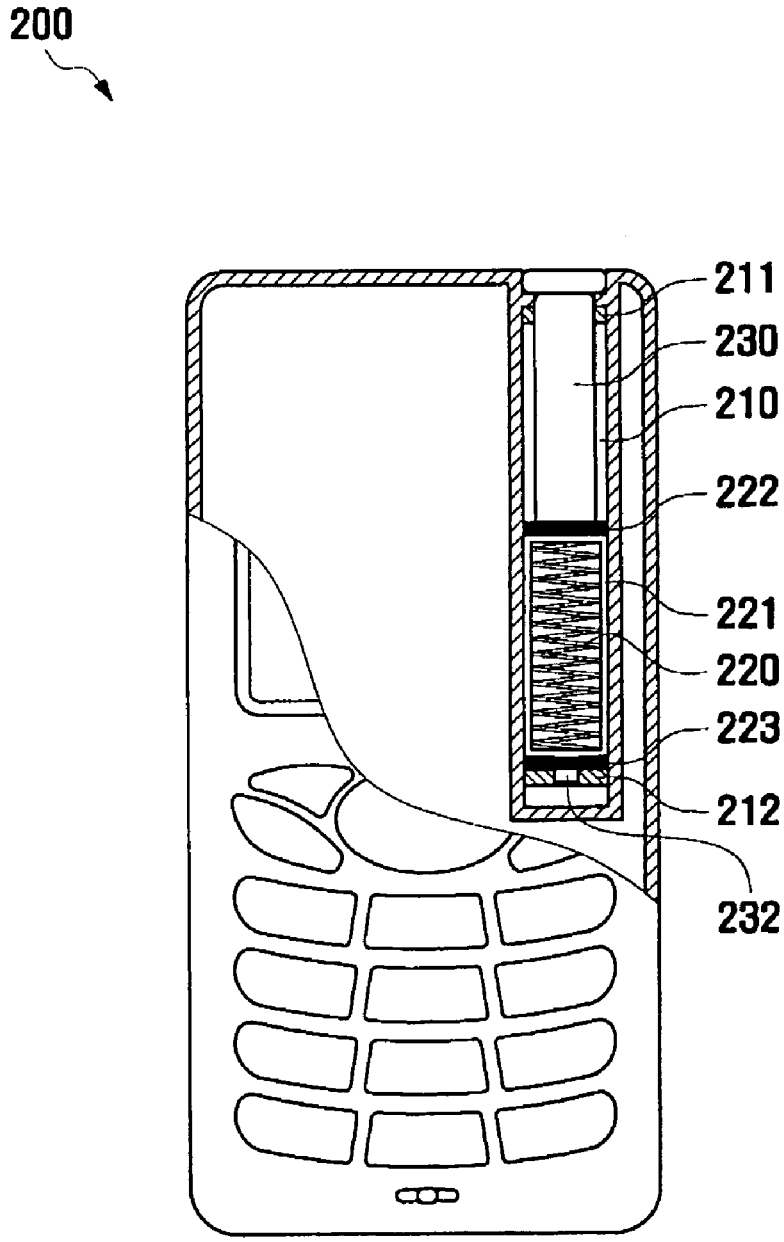
FIG. 2 is a partial cross-sectional view illustrating retraction of a dual band antenna unit for the mobile device of FIG. 1.

FIG. 2 is a partial cross-sectional view illustrating retraction of a dual band antenna unit for the mobile device 200 of FIG. 1.

When the second antenna part 230 is retracted, the first antenna part 220 is also retracted into the antenna receiving part 210 and the second contact point 223 will contact with the second feed point 212. The first antenna part 220 preferably has a protrusion 232 formed at a lower portion thereof. The protrusion 232 provides stable contact between the second contact point 223 and the second feed point 212.

When the second antenna part 230 is retracted, the resonant frequency corresponding to the second frequency band may be not retained. Because the first antenna part 220 is located in the antenna receiving part 210, the first antenna part 220 has the resonant frequency corresponding to the first frequency band. Thereby, the antenna unit transmits and receives signals of the first frequency band only.

Figure 3:
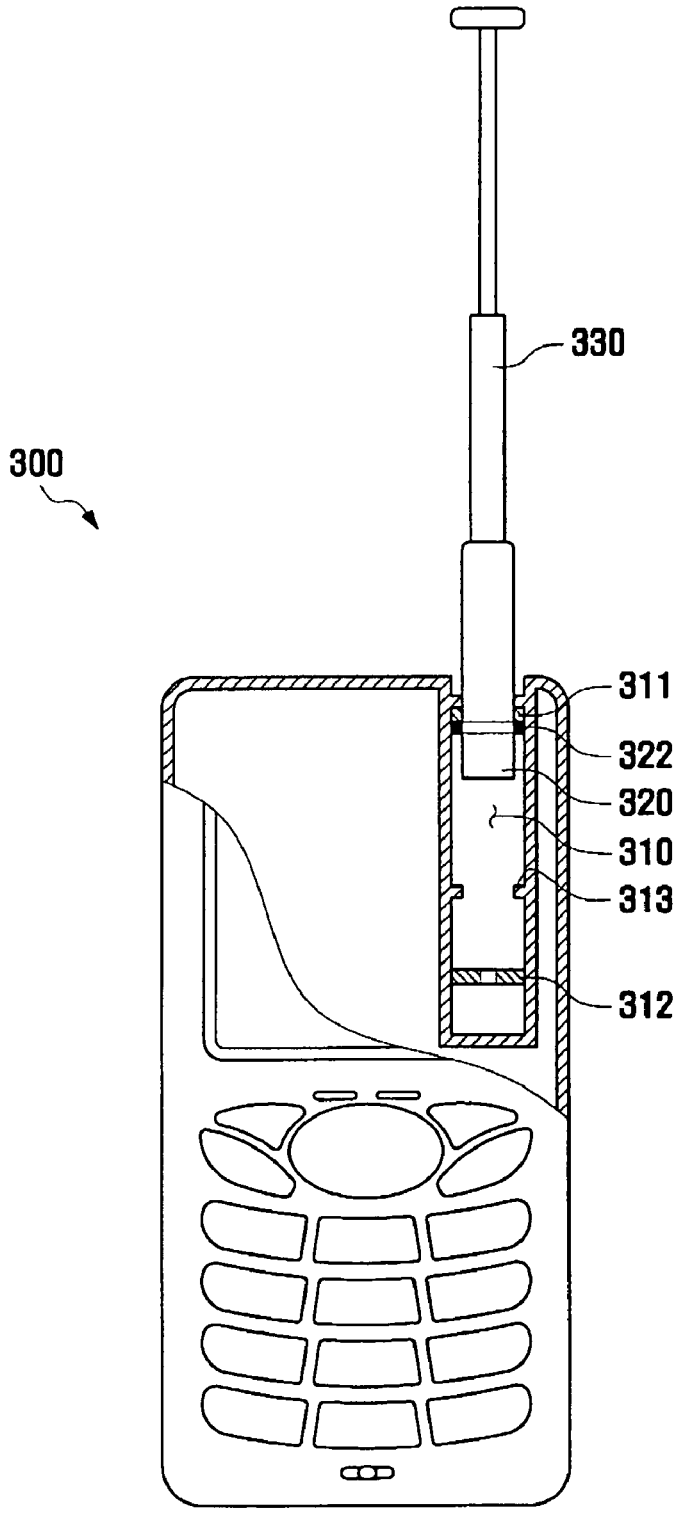
FIG. 3 is a partial cross-sectional view illustrating extraction of a dual band antenna unit for a mobile device according to another embodiment of the present invention.

FIG. 3 is a partial cross-sectional view illustrating extraction of a dual band antenna unit for a mobile device 300 in accordance with another embodiment of the present invention.

Referring to FIG. 3, the antenna unit may include an antenna, an antenna receiving part 310, a third feed point 311, a fourth feed point 312 and a stopper 313. The antenna is formed of three rods, each having different diameters. The antenna has a third contact point 322 and a fourth contact point 323 (shown in FIG. 4). The antenna is extractably and retractably mounted in the mobile device 300.

When the antenna is extracted, the antenna is divided into a third antenna part 330 and a fourth antenna part 320 with regard to the third contact point 322. The third antenna part 330 protrudes outwards from the mobile device 300 and the fourth antenna part 320 protrudes inwards into the mobile device 300. The third contact point 322 is in contact with the third feed point 311.

The third antenna part 330 has a resonant frequency corresponding to a third frequency band and the fourth antenna part 320 has a resonant frequency corresponding to a fourth frequency band. Therefore, the antenna unit transmits signals of different frequency bands. For example, the third frequency band may be a frequency band for digital broadcast signals and the fourth frequency band may be a frequency band for Bluetooth signals, thereby allowing the mobile device to simultaneously provide digital broadcast function and Bluetooth function using a single antenna unit.

Figure 4:
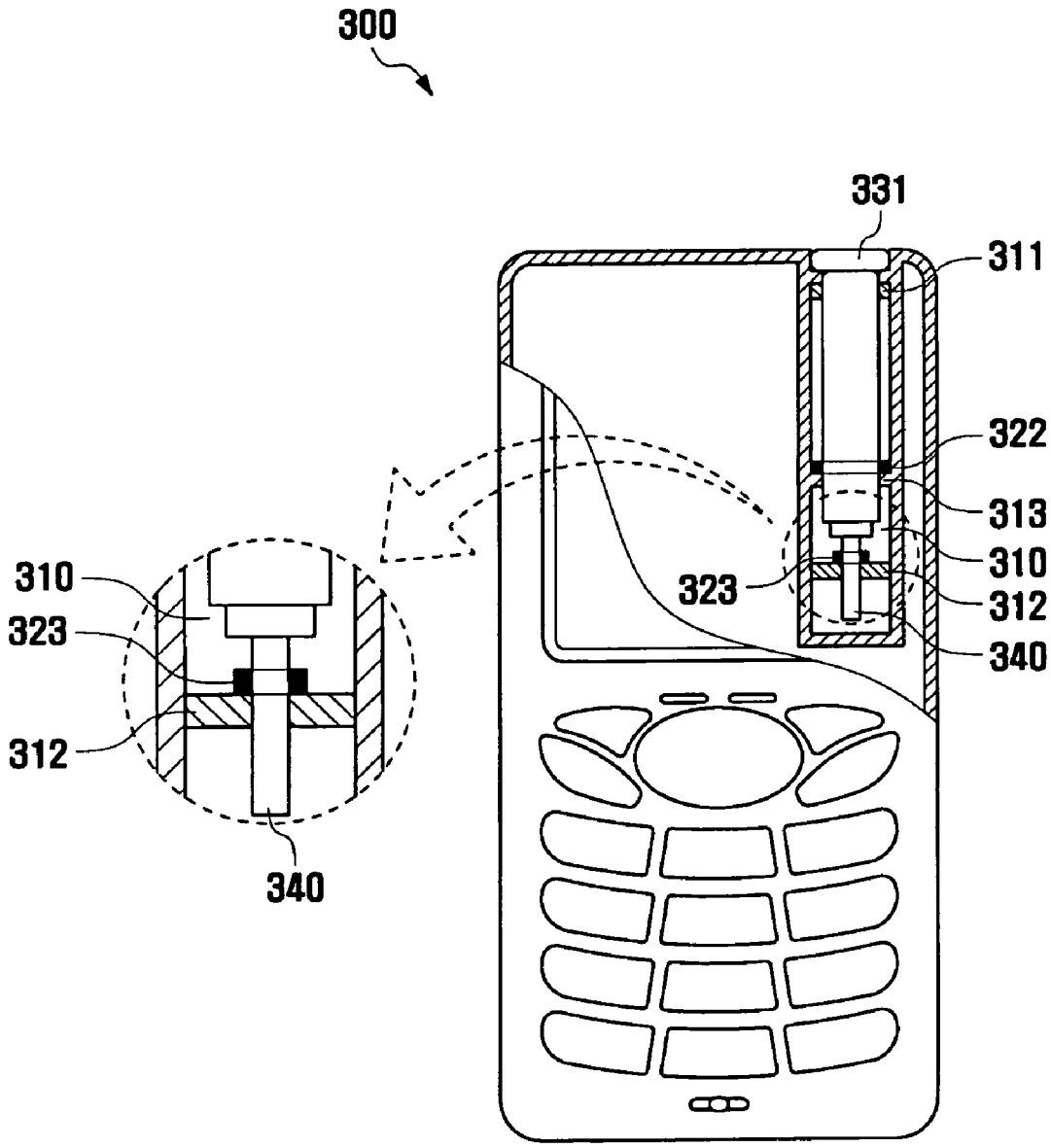
FIG. 4 is a partial cross-sectional view illustrating retraction of a dual band antenna unit for the mobile device of FIG. 3.

FIG. 4 is a partial cross-sectional view illustrating retraction of a dual band antenna unit for the mobile device 300 of FIG. 3. Referring to FIG. 4, the antenna includes a first rod having a largest diameter, a second rod having an intermediate diameter and a third rod having a smallest diameter. The first rod has a hole for receiving the second rod and the second rod has a hole for receiving the third rod.

The antenna is retractable such that the first rod is inserted in the antenna receiving part 310, the second rod is inserted in the hole of the first rod, and the third rod is inserted in the hole of the second rod. The third contact point 322 of the first rod is in contact with the stopper 313. The stopper 313 prevents further insertion of the first rod.

The third rod has a fourth contact point 323. When the antenna is retracted, the fourth contact point 323 contacts the fourth feed point 312. A fifth antenna part 340, which is a portion of the third rod, protrudes from the fourth contact point 323 in an inward direction of the mobile device 300.

The retraction of the antenna removes the resonant frequency corresponding to the third antenna part 330 and the fourth antenna part 320. The fifth antenna part 340 has a resonant frequency corresponding to a fifth frequency band. When the antenna is retracted, the mobile device 300 transmits and receives signals of the fifth frequency band only.

The antenna may have such a length that the resonant frequency corresponding to the fourth antenna 320 may be equal to the resonant frequency corresponding to the fifth antenna 340.

The mobile devices 200 and 300 may include mobile telecommunication applications, for example Personal Digital Assistants (PDAs), Global Positioning System (GPS), navigators, or digital broadcast receivers.

In accordance with the present invention, a mobile device transmits and receives signals of different frequency bands using a single antenna unit. Thereby the number of the used antenna may be reduced, thus resulting in a simple manufacturing process and a reduced antenna mounting space of a mobile device. The mobile device allows freedom of internal design and meet the demand for miniaturization.

Although the embodiments of the present invention have been described in detail hereinabove, it should be understood that many variations and modifications of the basic inventive concept herein described, which may appear to those skilled in the art, will still fall within the spirit and scope of the exemplary embodiments of the present invention as defined in the appended claims.

What is claimed is:

1. A dual band antenna unit for a mobile device, the antenna unit comprising:

a first antenna part having a resonant frequency corresponding to a first frequency band;

a first contact point formed in the first antenna part at an upper portion thereof;

a second contact point formed in the first antenna part at a lower portion thereof;

a second antenna part formed integrally with the first antenna part and extending from the first antenna part, the second antenna part being extractably and retractably mounted in the mobile device, and when the second antenna is extracted, the second antenna part has a resonant frequency corresponding to a second frequency band;

an antenna receiving part for receiving the first antenna part and the second antenna part;

a first feed point formed in the antenna receiving part at a first position thereof; and a second feed point formed in the antenna receiving part at a second, lower position thereof than the first feed point;

wherein extraction of the second antenna part connects the first contact point to the first feed point and retraction if the second antenna part connects the second contact point to the second feed point.

2. The dual band antenna unit of claim 1, wherein the first frequency band is a Bluetooth signal frequency band and the second frequency band is a digital broadcast signal frequency band.

3. The dual band antenna unit of claim 1, wherein the first antenna part is located within the mobile device.

4. The dual band antenna unit of claim 1, wherein the first antenna part is a helical antenna.

5. A dual band antenna unit for a mobile device, the antenna unit comprising:

an antenna receiving part;

an antenna extractably and retractably mounted in the mobile device, the antenna having a first contact point and a second contact point;

a first feed point formed in the antenna receiving part at an upper position thereof; and a second feed point formed in the antenna receiving part at a lower position thereof, wherein when the antenna is extracted, the first contact point is connected to the first feed point and the antenna is divided into a first antenna part and a second antenna part with regard to the first contact point, and when the antenna is retracted, the second contact point is connected to the second feed point and a portion of the antenna protrudes from the second contact point in an inward direction of the mobile device, the protruding portion of the antenna thereby being a third antenna part.

6. The dual band antenna unit of claim 5, wherein the first antenna part has a resonant frequency corresponding to a first frequency band and the second antenna part has a resonant frequency corresponding to a second frequency band.

7. The dual band antenna unit of claim 6, wherein the first frequency band is a digital broadcast signal frequency band and the second frequency band is a Bluetooth signal frequency band.

8. The dual band antenna unit of claim 5, wherein the third antenna part has a resonant frequency corresponding to a third frequency band.

9. The dual band antenna unit of claim 5, wherein the resonant frequency corresponding to the second antenna part is equal to the resonant frequency corresponding to the third antenna part.

10. The dual band antenna unit of claim 5, further comprising a stopper, wherein the first contact point is in contact with the stopper when the antenna is retracted.

* * * * *